US008994273B2

(12) United States Patent
Kornitz et al.

(10) Patent No.: US 8,994,273 B2
(45) Date of Patent: Mar. 31, 2015

(54) LIGHT-EMITTING DIODE FIXTURE WITH AN IMPROVED THERMAL CONTROL SYSTEM

(75) Inventors: Alexander Kornitz, Coquitlam (CA); Mirek Pospisil, West Vancouver (CA)

(73) Assignee: MP Design Inc., Vancouver (CA)

( * ) Notice: Subject to any disclaimer, the term of this patent is extended or adjusted under 35 U.S.C. 154(b) by 276 days.

(21) Appl. No.: 13/544,798

(22) Filed: Jul. 9, 2012

(65) Prior Publication Data

US 2014/0009064 A1 Jan. 9, 2014

(51) Int. Cl.

| | |
|---|---|
| ***H01J 7/24*** | (2006.01) |
| ***H01J 13/32*** | (2006.01) |
| ***H01J 17/28*** | (2006.01) |
| ***H01J 19/74*** | (2006.01) |
| ***H01J 61/52*** | (2006.01) |
| ***F21V 29/02*** | (2006.01) |
| ***H05B 33/08*** | (2006.01) |
| *F21Y 101/02* | (2006.01) |

(52) U.S. Cl.

CPC ..... *H05B 33/0803* (2013.01); *F21V 29/02* (2013.01); *F21V 29/763* (2013.01); *F21Y 2101/02* (2013.01)

USPC ..... 315/113; 362/373

(58) Field of Classification Search

None

See application file for complete search history.

(56) References Cited

U.S. PATENT DOCUMENTS

| | | | | |
|---|---|---|---|---|
| 6,994,046 | B2 | 2/2006 | Kaji et al. | |
| 7,144,140 | B2 | 12/2006 | Sun et al. | |
| 7,329,030 | B1 | 2/2008 | Wang | |
| 7,467,595 | B1 | 12/2008 | Lanyi et al. | |
| 7,626,213 | B2 | 12/2009 | Lin | |
| 7,637,633 | B2 | 12/2009 | Wong | |
| 7,699,501 | B2 | 4/2010 | Liu | |
| 7,800,119 | B2 | 9/2010 | He et al. | |
| 7,841,753 | B2 | 11/2010 | Liu | |
| 7,874,710 | B2 | 1/2011 | Tsai et al. | |
| 8,057,071 | B2 | 11/2011 | He et al. | |
| 8,070,306 | B2 | 12/2011 | Ruud et al. | |
| 2006/0215408 | A1 | 9/2006 | Lee | |
| 2010/0027276 | A1* | 2/2010 | Kornitz et al. | 362/373 |
| 2013/0285545 | A1* | 10/2013 | Shah et al. | 315/50 |
| 2014/0001956 | A1* | 1/2014 | Ter Weeme et al. | 315/113 |

* cited by examiner

*Primary Examiner* — Douglas W Owens
*Assistant Examiner* — Dedei K Hammond
(74) *Attorney, Agent, or Firm* — Cameron IP

(57) ABSTRACT

A light-emitting diode fixture comprises spaced-apart first and second housing portions. There is a cooling device disposed within the first housing portion. The cooling device is in fluid communication with the second housing portion. First and second printed circuit boards are disposed within the second housing portion. A light-emitting diode and a negative coefficient thermistor array are mounted on the first printed circuit board. The light-emitting diode and the negative coefficient thermistor array are each thermally coupled to a heat sink. A rectifier is mounted on the second printed circuit board. The rectifier is electrically connected in series with the negative coefficient thermistor array and the cooling device. Current used to power the cooling device flows from the rectifier through the negative coefficient thermistor array to the cooling device.

12 Claims, 4 Drawing Sheets

LIGHT-EMITTING DIODE FIXTURE WITH AN IMPROVED THERMAL CONTROL SYSTEM

BACKGROUND OF THE INVENTION

1. Field of the Invention

The present invention relates to a light-emitting diode fixture and, in particular, to a light-emitting diode fixture with an improved thermal control system.

2. Description of the Related Art

Light-emitting diodes, like any semiconductor, emit heat during their operation. This is because not all of the electrical energy provided to a light-emitting diode is converted to luminous energy. A significant portion of the electrical energy is converted to thermal energy which results in an increase in the temperature of the light-emitting diode. In resistor driven circuits, as the temperature of the light-emitting diode increases, the forward voltage drops and the current passing through the PN junction of the light-emitting diode increases. The increased current causes additional heating of the PN junction and may thermally stress the light-emitting diode.

Thermally stressed light-emitting diodes lose efficiency and their output is diminished. In certain situations, optical wavelengths may even shift causing white light to appear with a blue tinge. Thermally stressed light-emitting diodes may also impose an increased load on related driver components causing their temperature to increase as well. This may result in broken wire bonds, delaminating, internal solder joint detachment, damage to die-bond epoxy, and lens yellowing. If nothing is done to control the increasing temperature of the light emitting diode, the PN junction may fail, possibly resulting in thermal runaway and catastrophic failure.

Thermal control of light-emitting diodes involves the transfer of thermal energy from the light-emitting diode. Accordingly, one aspect of light-emitting diode fixture design involves efficiently transferring as much thermal energy as possible away from the PN junction of the light-emitting diode. This can generally be accomplished, at least in part, through the use of a heat sink. However, for more powerful light-emitting diode fixtures in the 20 to 60 watt range or in applications where numerous light-emitting diodes are disposed within a confined space, an additional cooling means may be required to maintain performance. This is because the thermal energy generated by the light-emitting diodes may at times exceed the thermal energy absorbed and dissipated by the heat sink. In these situations a cooling fan is typically used in combination with the heat sink.

In a conventional thermal control system for light-emitting diode fixtures, a heat sink and a cooling fan are thermally coupled to a light source comprised of a plurality of light-emitting diodes. A thermal sensor senses the temperature of the light source and signals a controller to operate a variable speed cooling fan, based on the temperature of the light source, to maintain the fixture within a desired temperature range. However, the need for a controller, typically in the form of a microprocessor, increases the number of components in the thermal control system and thereby increases manufacturing costs.

SUMMARY OF THE INVENTION

It is an object of the present invention to provide an improved light-emitting diode fixture.

There is accordingly provided a light-emitting diode fixture comprising a first housing portion and a second housing portion spaced-apart from the first housing portion. A cooling device is disposed within the first housing portion and is in fluid communication with the second housing portion. First and second printed circuit boards are disposed within the second housing portion. A light-emitting diode and a negative coefficient thermistor array are mounted on the first printed circuit board. A heat sink is thermally coupled to both the light-emitting diode and the negative coefficient thermistor array. A rectifier is mounted on the second printed circuit board. The rectifier is electrically connected in series with the cooling device and the negative coefficient thermistor array. Current used to power the cooling device flows from the power supply to the cooling device and through the negative coefficient thermistor array. The negative coefficient thermistor array controls said current flow from the power supply to the cooling device based on a temperature of the heat sink which is thermally coupled to the thermistor array, thereby controlling the output of the cooling device based on the temperature of the heat sink. The current used to power the cooling device may also flow through an LED array. The negative coefficient thermistor array may be connected in series in the powering line (wire) of the cooling device. There may also be a positive coefficient thermistor mounted on the first printed circuit board. The positive coefficient thermistor may be thermally coupled to the heat sink.

The first housing portion may be vented and the second housing portion may be vented. The fixture may further include a collar disposed about the light-emitting diode. The heat sink and the collar may be on opposite sides of the first printed circuit board. There may be an aperture in the first printed circuit board and at least two radially extending fins on the collar. The aperture in the first printed circuit board may be disposed between said at least two radially extending fins on the collar. There may be a reflector which is thermally coupled to the collar. There may be a passageway extending through the heat sink. The aperture in the first printed circuit board and the passageway in the heat sink may be aligned.

The light-emitting diode fixture may also include a positive coefficient thermistor, a switching diode, a resistor array, a setting resistor and an indicator. The light-emitting diode may be connected with the rectifier and the positive coefficient thermistor. The light-emitting diode may be electrically connected with the positive coefficient thermistor and the switching diode. The switching diode may be electrically connected with the resistor array and the setting resistor. The setting resistor may be connected with the switching diode and the indicator. The positive coefficient thermistor, resistor array and light-emitting diode indicator may all be connected to a negative bus of the rectifier. The positive coefficient thermistor is mounted on the first printed circuit board. The indicator may be a light emitting diode indicator.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1:
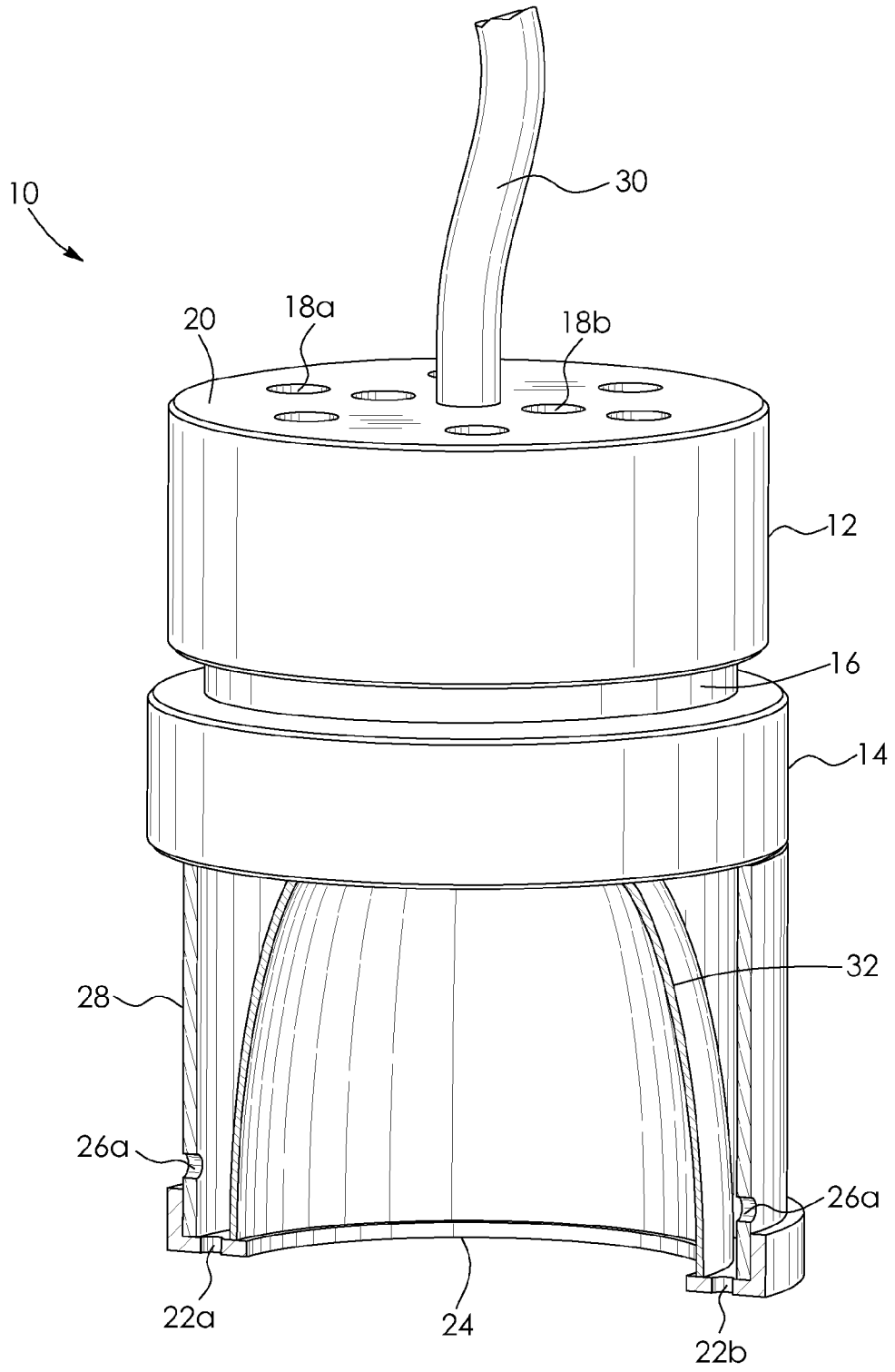
FIG. 1 is a perspective, partially broken away view of an improved light-emitting diode fixture.

Referring to the drawings and first to FIG. 1 an improved light-emitting diode fixture 10 is shown. The light-emitting diode fixture 10 includes a first housing portion 12 and a second housing portion 14. The first housing portion 12 and second housing portion 14 are spaced apart and coupled by a connector 16. The connector is hollow and permits fluid communication between the first housing portion 12 and the second housing portion 14. In this example the connector 16 is integral with the first housing portion 12. In other examples the connector may be integral with the second housing portion or the connector may be a separate component. The first housing portion 12 is vented and has a plurality of openings, for example openings 18*a* and 18*b*, which extend through an end 20 of the first housing portion which is opposite of connector 16. The second housing portion 14 is also vented and has a plurality of openings, for example openings 22*a* and 22*b*, which extend through an end 24 of the second housing portion which is opposite of the connector 16. There are also openings, for example openings 26*a* and 26*b*, in a side wall 28 of the second housing portion 14. Wiring 30 extends from the first housing portion 12 and there is a reflector 32 disposed within the second housing portion 14.

Figure 2A:
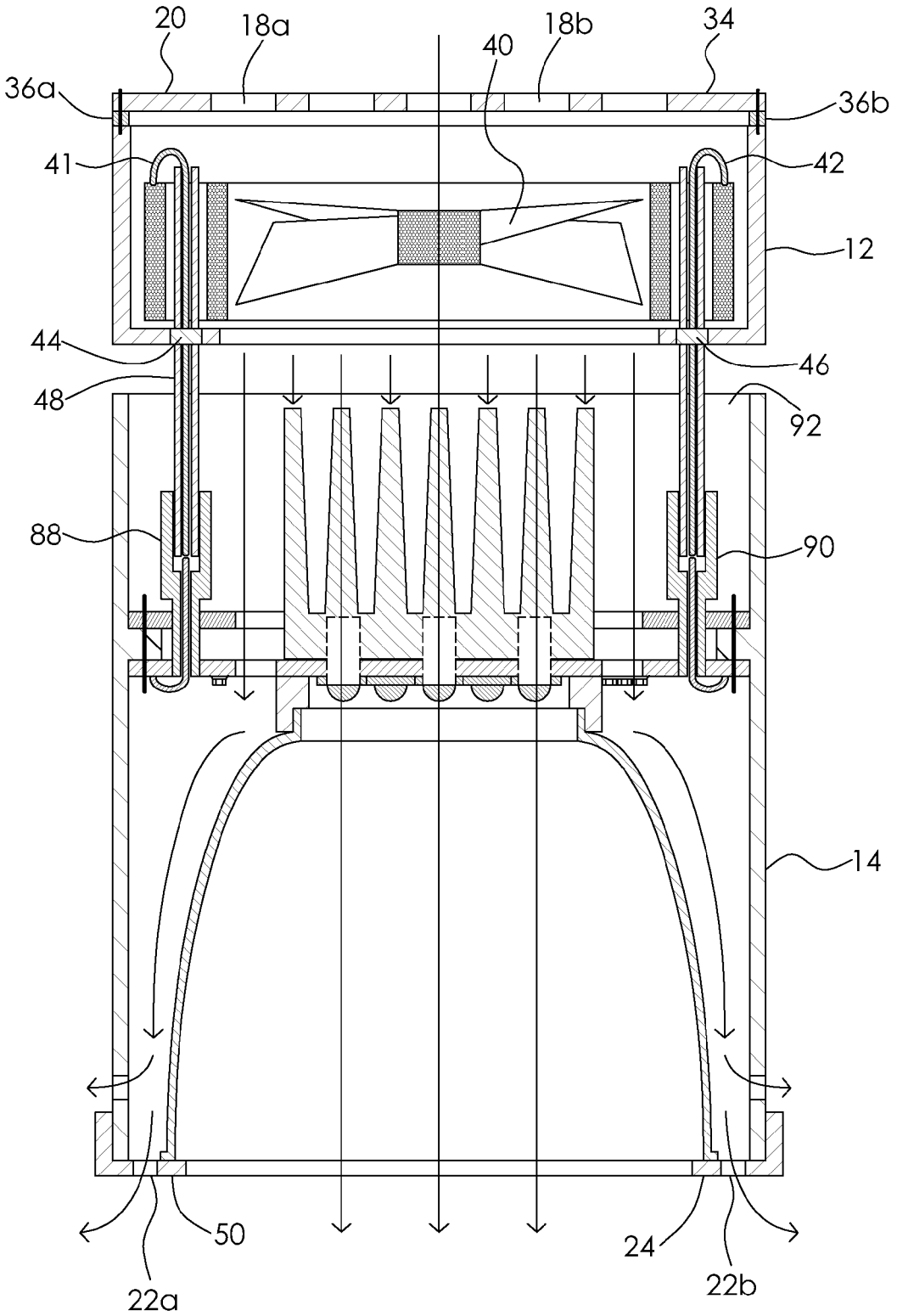
FIGS. 2A and 2B are section views of the light-emitting diode fixture of FIG. 1.
Figure 2B:
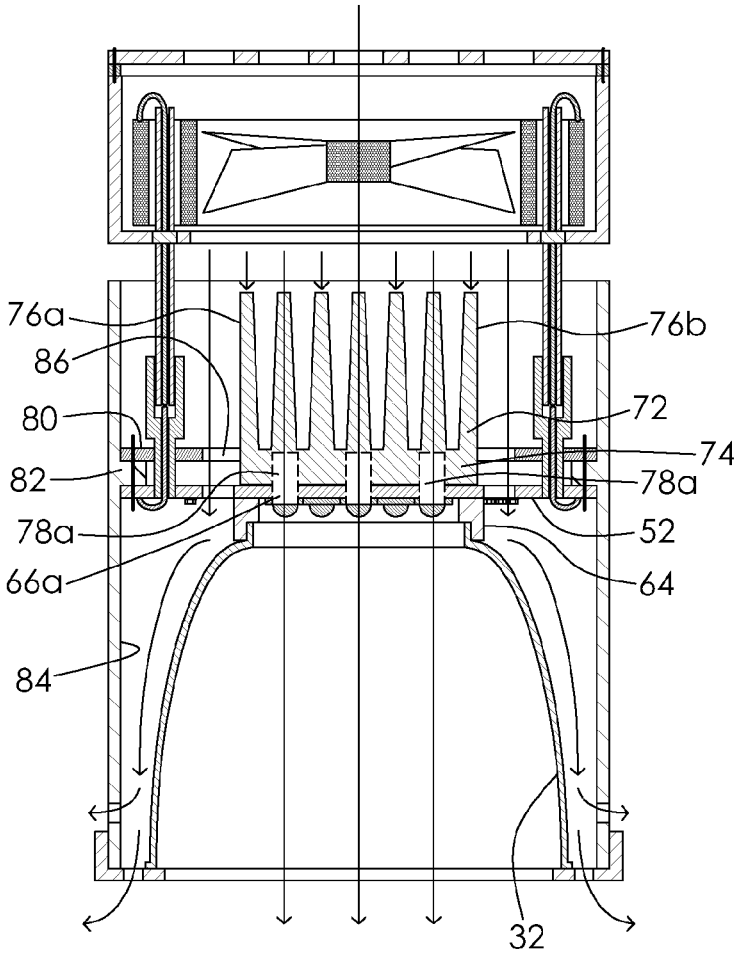

The first housing portion 12 and the second housing portion 14 of the fixture 10 are shown in greater detail in FIGS. 2A and 2B. In this example, and as shown in FIG. 2A, the first housing portion 12 has a perforated lid 34 which forms the end 20 of the first housing portion with the plurality of openings 18*a* and 18*b*. The perforated lid 34 is releasably secured to the first housing portion 12 with stand-off connectors 36*a* and 36*b*. Release and removal of the perforated lid 34 allows access to an interior of the first housing portion 12. There is a cooling device in the form of a fan 40 in this example disposed within the first housing portion 12 together with positive fan wire 41 and the negative fan wire 42. The positive fan wire 41 and a negative fan wire 42 run from the first housing portion 12, through respective isolator switches 44 and 46, to the connector 16. The positive fan wire 40 and the negative fan wire 42 may run through a side wall 48 of the connector 16 as shown in FIG. 2A.

Figure 3:
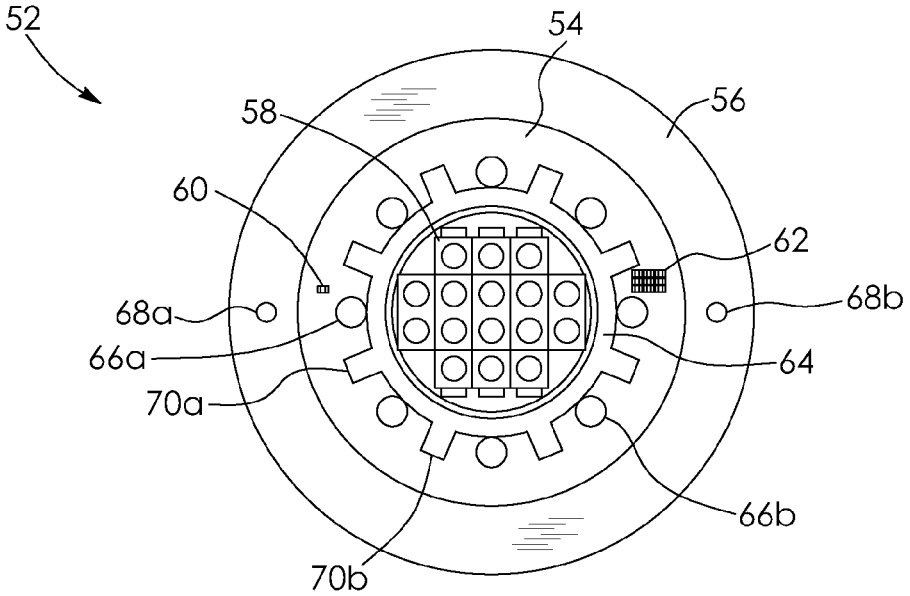
FIG. 3 is an elevation view of a printed circuit of the light-emitting diode fixture of FIG. 1.

In this example the second housing portion 14 also has a perforated lid 50. The perforated lid 50 of the second housing portion 14 forms the end 24 of the second housing portion 14 with the plurality of openings 22*a* and 22*b*. The perforated lid 50 is threadedly secured to the second housing portion 14, but is releasable to allow access to an interior of the second housing portion 14. Referring now to FIG. 2B, there is a first printed circuit board 52 disposed within the second housing portion 14. In this example, the first printed circuit board 52 is a first printed circuit board which is shown in greater detail in FIG. 3. The first printed circuit board 52 has a metal core 54 surrounded by a non-conductive substrate 56. There is an LED array 58 mounted on the metal core 54 together with a positive coefficient thermistor 60 and a negative coefficient thermistor array 62. The LED array 58 is surrounded by thermal collar 64 which is thermally coupled to the first printed circuit board 52. There are also apertures, for example apertures 66*a* and 66*b*, in the metal core 54 of the first printed circuit board 52 as well as apertures, for example apertures 68*a* and 68*b*, in the surrounding non-conductive substrate 56 of the first printed circuit board 52. The thermal collar 64 has a plurality of radial fins, for example radial fins 70*a* and 70*b*, that are positioned such that the apertures 66*a* and 66*b* in the metal core are between the radial fins in this example. The thermal collar may be made of aluminium. The shape of the apertures 66*a* and 66*b* may affect airflow.

Referring back to FIG. 2B, the thermal collar 64 couples the first printed circuit board 52 to the reflector 32. In this example the reflector 32 is metallic and may function to increase the surface area upon which convective heat exchange may occur. There is also a heat sink 72 thermally coupled to the first circuit board 52. The thermal collar 64 and heat sink 72 are on opposite sides of the first printed circuit board 52. This allows for heat exchange to occur on both sides of the first printed circuit board 52. In this example the heat sink has a base 74 and a plurality of fins, for example fins 76*a* and 76*b*, extending from the base. There are a plurality of passageways, for example passageways 78*a* and 78*b*, extending through the base 74 of heat sink 70. The apertures in the base of the heat sink are aligned with the apertures in the metal core 54 of the first printed circuit board 52 as shown in FIG. 2B for apertures 66*a* and 78*a*. This allows air to flow from the fan through the second housing portion 14 of the fixture 10. Air may also flow through the apertures 68*a* and 66*b* in the substrate 56 of the first printed circuit board 52.

A second printed circuit board 80 is also disposed within the second housing portion 14. The second printed circuit board 80 is spaced apart from the first printed circuit board 52 by a flange 82 which extends along an inner wall 84 of the second housing portion 14. In this example there is a central opening 86 in the second printed circuit board 80 to allow the heat sink 72 to extend through the second printed circuit board as shown in FIG. 2B. The central opening 86 in the second printed circuit board 80 also allows air to flow through second printed circuit board and into the second housing portion 14. Employing both the first printed circuit board 52 and the second printed circuit board 80 may decrease the thermal load on each of the printed circuit boards.

Referring back to FIG. 2A, there are stand-off connectors 88 and 90 disposed within the second housing portion 14. The stand-off connectors 88 and 90 face an open end 92 of the second housing portion 14. In this example the connector 16 is received by the open end 92 of the second housing portion 14 and the connector 16 engages the stand-off connectors 88 and 90. This mechanically couples the first housing portion 12 to the second housing portion 14 and completes the electric circuitry of the fixture 10. This is because the positive fan wire 41 and the negative fan wire 42 run from the first housing portion through connector 16 to the printed circuit boards 52 and 80 disposed in the second housing portion 14. The stand-off connectors 88 and 90 also ensure an electrical connection between the printed circuit boards 52 and 80.

Figure 4:
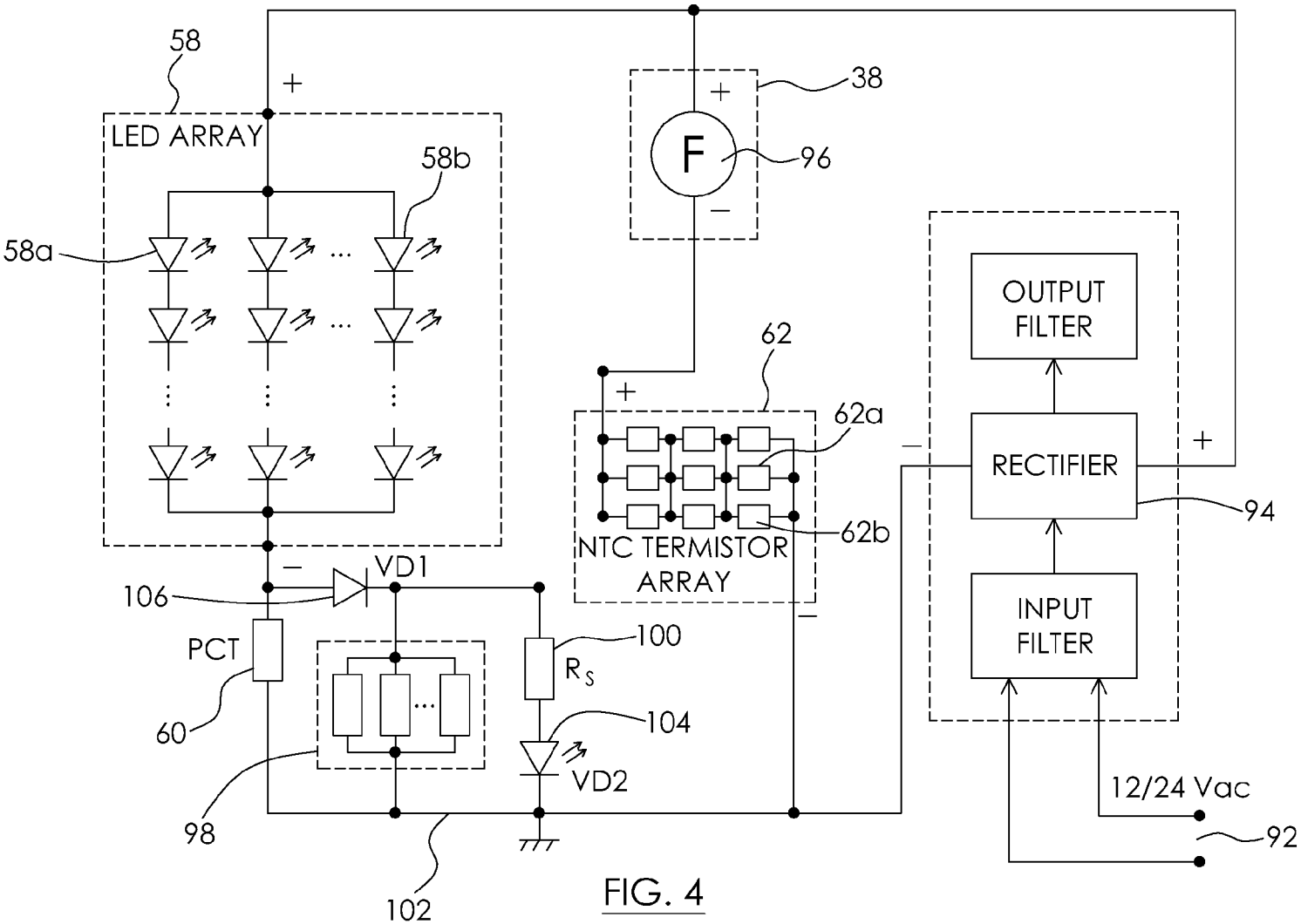
FIG. 4 is a circuit diagram of the light-emitting diode fixture of FIG. 1.

Referring now to FIG. 4 a circuit diagram of the fixture 10 of FIG. 1 is shown. A plurality of light-emitting diodes, for example light-emitting diodes 58*a* and 58*b*, form the LED array 58. The light-emitting diodes may be electrically connected in both parallel and series. An AC power supply 92 provides current to the fixture. A rectifier 94 in the fixture rectifies the alternating current to direct current which powers the LED array 58. The direct current also powers a motor 96 of the fan 38. The positive terminal of the rectifier 94 is electrically connected in parallel to the positive terminal of the LED array 58 and the positive terminal of the fan motor 96.

The negative coefficient thermistor array 62 is electrically connected in series between a negative terminal of the fan motor 96 and a negative terminal of the rectifier 94. The negative coefficient thermistor array 62 includes a plurality of negative coefficient thermistors, for example negative coefficient thermistors 62*a* and 62*b*, which are thermally coupled to the heat sink 72 by means of the first printed circuit board 52 as shown in FIGS. 2A and 2B. The negative coefficient thermistors 62*a* and 62*b* may be electrically connected in both parallel and series. The negative coefficient thermistor array 62 is sensitive to the temperature of the heat sink 72. As the temperature of the heat sink 72 increases, the resistance of the negative coefficient thermistor array 62 decreases. As the temperature of the heat sink 72 decreases, the resistance of the negative coefficient thermistor array 62 increases. Accordingly, the flow of direct current to the fan motor 96 is dependent on the temperature of the heat sink 72. The negative coefficient thermistor array 62 generally functions in manner as described in U.S. Pat. No. 8,070,324 which issued on Dec. 6, 2011 to Kornitz et al., and the full disclosure of which is incorporated herein by reference. However, in this example as part of a negative feedback control loop.

There is a positive coefficient thermistor 60 electrically connected in series between the negative terminal of the rectifier 94 and the negative terminal of the LED array 58. The positive coefficient thermistor 60 functions to protect the LED array 58 from overheating in combination with overcurrent. There is also a resistor array 98 electrically connected in series between the negative terminal of the rectifier 92 and the negative terminal of the LED array 58 through a switching diode 106. The resistor array 98 functions to restrict the current flowing to the LED array 58 when the LED array 58 overheats and may make the fixture more energy efficient. The positive coefficient thermistor 60 and resistor array 98 are electrically connected in parallel along a common negative bus. There is also a resistor 100 and an indicator in the form of a light-emitting diode 104 electrically connected in series between the cathode of the switching diode 106 and the common negative bus 102. The resistor 100 is electrically connected to an anode of the light-emitting diode 104 and a cathode of the light-emitting diode 104 is electrically connected to the negative bus 102. The resistor 100 is a setting resistor and functions as a setting device of the light-emitting diode 104. The light emitting diode 104 functions as an indicator of the regime of the fixture. The negative terminal of the LED array 58 is electrically connected with an anode of the switching power diode 106. A cathode of the switching power diode 106 is electrically connected with resistor array 98 and resistor 100.

Employing two printed circuit boards 52 and 80, shown in FIG. 2B, allows for separate arrangement of components of the electric circuitry. This decreases the thermal load on the individual printed circuit boards 52 and 80. In this example the LED array 58, negative coefficient thermistor array 62, and positive coefficient thermistor 60 are disposed on the first printed circuit board 52. The integrated microcircuits for the rectifier 94, the resistor array 98 and the resistor 100, and the diodes 104 and 106 are disposed on the second printed circuit board 80. Separation of heat releasing elements in the electric circuitry assists in heat dissipation in the fixture.

It will be understood by a person skilled in the art that many of the details provided above are by way of example only, and are not intended to limit the scope of the invention which is to be determined with reference to the following claims.

What is claimed is:

1. A light-emitting diode fixture comprising:

a first housing portion;

a second housing portion spaced-apart from the first housing portion;

a cooling device disposed within the first housing portion and in fluid communication with the second housing portion;

a first printed circuit board and a second printed circuit board disposed within the second housing portion;

a light-emitting diode and a negative coefficient thermistor array mounted on the first printed circuit board;

a heat sink thermally coupled to the light-emitting diode and the negative coefficient thermistor array;

a rectifier mounted on the second printed circuit board, the rectifier being electrically connected in series with the negative coefficient thermistor array and the cooling device, wherein current used to power the cooling device flows from the rectifier to the cooling device and through the negative coefficient thermistor array, and the negative coefficient thermistor array controls said current flow from the rectifier to the cooling device based on a temperature of the heat sink which is thermally coupled to the thermistor array, thereby controlling the output of the cooling device based on the temperature of the heat sink; and a positive coefficient thermistor, a switching diode, a resistor array, a setting resistor and an indicator, wherein the light-emitting diode is connected with the rectifier and the positive coefficient thermistor, the light-emitting diode is electrically connected with the positive coefficient thermistor and the switching diode, the switching diode is electrically connected with the resistor array and the setting resistor, the setting resistor is connected to the switching diode and the indicator, and the positive coefficient thermistor, resistor array and indicator are connected to a negative bus of the rectifier.

2. The light-emitting diode fixture as claimed in claim 1 wherein the first housing portion is vented.

3. The light-emitting diode fixture as claimed in claim 1 wherein the second housing portion is vented.

4. The light-emitting diode fixture as claimed in claim 1 further including a collar disposed about the light-emitting diode.

5. The light-emitting diode fixture as claimed in claim 4 wherein the heat sink and the collar are on opposite sides of the first printed circuit board.

6. The light-emitting diode fixture as claimed in claim 4 further including an aperture in the first printed circuit board and at least two radially extending fins on the collar, wherein the aperture in the first printed circuit board is disposed between said at least two radially extending fins on the collar.

7. The light-emitting diode fixture as claimed in claim 4 further including a reflector which is thermally coupled to the collar.

8. The light-emitting diode fixture as claimed in claim 1 further including an aperture in the first printed circuit board and a passageway extending through the heat sink, wherein the aperture in the first printed circuit board and the passageway in the heat sink are aligned.

9. The light-emitting diode fixture as claimed in claim 1 wherein the heat sink is mounted on the first printed circuit board.

10. The light-emitting diode fixture as claimed in claim 1 wherein the positive coefficient thermistor is mounted on the first printed circuit board.

11. The light-emitting diode fixture as claimed in claim 1 wherein the indicator is a light-emitting diode indicator.

12. The light-emitting diode fixture as claimed in claim 1 wherein the light-emitting diode is part of an LED array.

* * * * *